US011339579B1

(12) United States Patent
Stearns

(10) Patent No.: US 11,339,579 B1
(45) **Date of Patent: *May 24, 2022**

(54) ELECTRICALLY POWERED POOL VACUUM CLEANER

(71) Applicant: Kenneth W Stearns, Houston, TX (US)

(72) Inventor: Kenneth W Stearns, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/105,493

(22) Filed: Nov. 25, 2020

Related U.S. Application Data

(63) Continuation-in-part of application No. 16/695,131, filed on Nov. 25, 2019, now Pat. No. 11,136,774, which is a continuation-in-part of application No. 15/872,135, filed on Jan. 16, 2018, now Pat. No. 10,487,525.

(60) Provisional application No. 62/507,492, filed on May 17, 2017.

(51) Int. Cl.
*E04H 4/16* (2006.01)
*A47L 9/14* (2006.01)
*A47L 9/28* (2006.01)

(52) U.S. Cl.
CPC ..... *E04H 4/1636* (2013.01); *A47L 9/1436* (2013.01); *E04H 4/1654* (2013.01); *A47L 9/2884* (2013.01)

(58) Field of Classification Search
CPC ..... E04H 4/1636; E04H 4/1654
See application file for complete search history.

(56) References Cited

U.S. PATENT DOCUMENTS 4,100,641 A * 7/1978 Pansini ..... E04H 4/1654 15/1.7
2011/0258789 A1* 10/2011 Lavabre ..... E04H 4/1654 15/1.7

* cited by examiner

*Primary Examiner* — Randall E Chin
(74) *Attorney, Agent, or Firm* — Nick A. Nichols, Jr.

(57) ABSTRACT

An electrically powered pool cleaner may include a housing defining an axial passageway. A rotatable sleeve impeller may be supported by the housing within the axial passageway. The axial passageway may include an unobstructed central portion for passage of fluid and pool debris therethrough into a filter bag removably connected to the housing. A motor may be operatively connected to the sleeve impeller and a power supply operatively connected to the motor. Rotation of the sleeve impeller may accelerate fluid flow through the axial passageway for drawing into the filter bag. The pool cleaner may include a rigid cover enclosing the filter components. The rigid cover may include a handle for handheld operation of the pool cleaner.

14 Claims, 5 Drawing Sheets

ELECTRICALLY POWERED POOL VACUUM CLEANER

CROSS-REFERENCE TO RELATED APPLICATION

This is a continuation-in-part of U.S. Non-Provisional application Ser. No. 16/695,131, filed Nov. 25, 2019, U.S. Pat. No. 11,136,774, which is a continuation-in-part of U.S. Non-Provisional application Ser. No. 15/872,135, filed Jan. 16, 2018, U.S. Pat. No. 10,487,525, which claims priority to and the benefit of the filing of U.S. Provisional Application Ser. No. 62/507,492, filed May 17, 2017, which applications are herein incorporated by reference in their entirety.

BACKGROUND

The present invention relates to pool cleaners, and in particular to electrically powered swimming pool vacuums.

Electrically powered pool vacuums are similar in many respects to manually operated pool cleaners that use a garden hose attached to the cleaner to create suction to pull leaves and other debris off the bottom of the pool. Instead of water pressure, however, electrically powered pool cleaners generally include a motor and an impeller to create the suction required to pull leaves from the bottom of the pool. These pool cleaners may be battery powered and some may include a battery located out of the pool with a power cord connected to the vacuum unit in the pool. Others may include a battery compartment on the cleaner housing. The motor and impeller are typically in the water flow path through the vacuum unit. A collection bag attached to the top of the vacuum unit captures the leaves and debris for disposal away from the pool.

SUMMARY

An electrically powered pool cleaner may include a housing defining an axial passageway. A rotatable sleeve impeller may be supported by the housing within the axial passageway. The axial passageway may include an unobstructed central portion for passage of fluid and pool debris therethrough into a filter bag removably connected to the housing. A motor may be operatively connected to the sleeve impeller and a power supply operatively connected to the motor. Rotation of the sleeve impeller may accelerate fluid flow through the axial passageway for drawing into the filter bag. The pool cleaner may include a rigid cover enclosing the filter components. The rigid cover may include a handle for handheld operation of the pool cleaner.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
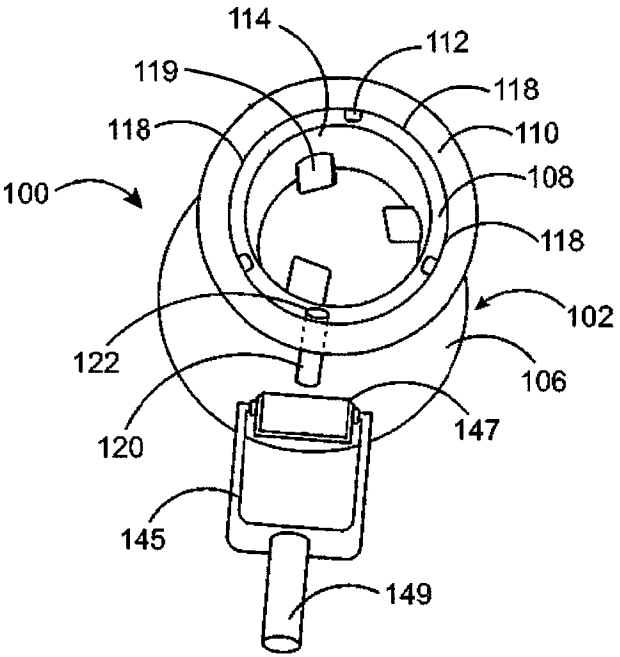
FIG. 1 is a perspective view of an electrically powered pool cleaner.

Referring first to FIG. 1, an electrically powered pool vacuum cleaner is generally identified by the reference numeral 100. The pool vacuum cleaner 100 may be submersed in a swimming pool or other water-filled structure and operated to remove debris, such as leaves, dirt and twigs, from the bottom and wall surface of the pool. The pool vacuum cleaner 100 may include a housing 102 mounted on a plurality of wheels 104 (shown in FIG. 4) for moving the pool vacuum cleaner 100 over the surface of the pool. The housing 102 may include a flared base 106 and a generally cylindrical conduit 108 extending upwardly from the base 106. The upper end of the cylindrical conduit 108 may be circumscribed by a radially extending flared lip 110.

The cylindrical conduit 108 defines an axial passageway 112 extending through the housing 102. The cylindrical portion 108 may be integrally formed with the base 106 and flared lip 110. Alternatively, the cylindrical conduit 108 may snap on or otherwise connected to the base 106. The lower end of the passageway 112 defines an inlet port for the pool vacuum cleaner 100 and the upper end thereof defines a discharge outlet. A removable flexible mesh filter bag (not shown in the drawings) having an opening at one end may be slipped over the flared lip 110 and a draw string tightened to hold the filter bag in place. Water and debris in the pool may be drawn through the passageway 112 and into the filter bag where the debris is trapped in the filter bag and the filtered water passes through the mesh bag back into the pool.

Figure 2:
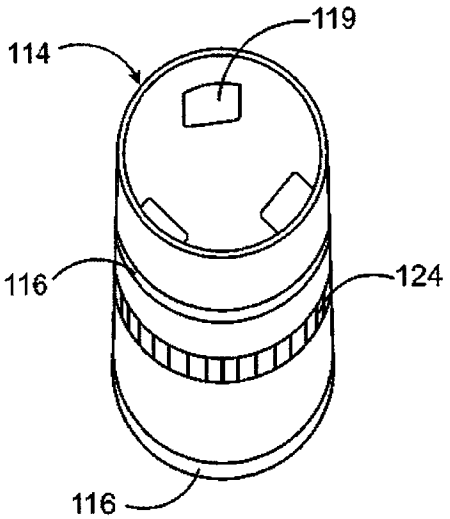
FIG. 2 is a perspective view of a sleeve component of the pool cleaner shown in FIG. 1.

An impeller or sleeve 114 may be mounted within the passageway 112 of the housing 102. The sleeve 114 may be rotatably secured within the cylindrical conduit 108 of the housing 102. The sleeve 114 may include one or more circumferential grooves 116, best shown in FIG. 2, formed on the external surface of the sleeve 114. The grooves 116 may be sized to receive a plurality of rollers 118 which rotatably support the sleeve 114 within the housing 102. The cylindrical conduit 108 of the housing 102 may also include internal circumferential grooves located opposite the grooves 116 for cooperatively supporting the rollers 118 therebetween.

Blades 119 may be fixedly secured to the internal surface of the sleeve 114. The blades 119 project toward the center of the passageway 112 and are configured so that upon rotation of the sleeve 114, fluid flow is accelerated upwardly through the center core of the fluid passageway 112. Water and debris in the pool from below the pool vacuum cleaner 100 may be drawn upwardly through the passageway 112 and into the filter bag where the debris is trapped in the filter bag and the filtered water passes through the mesh bag back into the pool.

One or more sets of blades 119 vertically spaced from one another may be fixedly secured to the sleeve 114. The blades 119 may extend toward the axial center of the sleeve 114 without obstructing the central portion of the fluid passageway 112. Water and entrained debris may thereby flow through the unobstructed central portion of the passageway 112 into the collection mesh bag.

Continuing with FIG. 1, a motor 120 may be mounted on the exterior of the housing 102. The motor 120 may be of a type suitable for underwater operation. The motor 120 may drive a pinion gear 122 engaging a ring gear 124 mounted on the exterior surface of the sleeve 114.

Electrical energy to operate the motor 120 may be provided by batteries located on the housing 102. Alternatively, battery power may be provided remotely through an electrical cord connecting the batteries to the motor 120. Under remote operation, a switch may be provided to operate the pool cleaner 100 in turbo mode.

Figure 3:
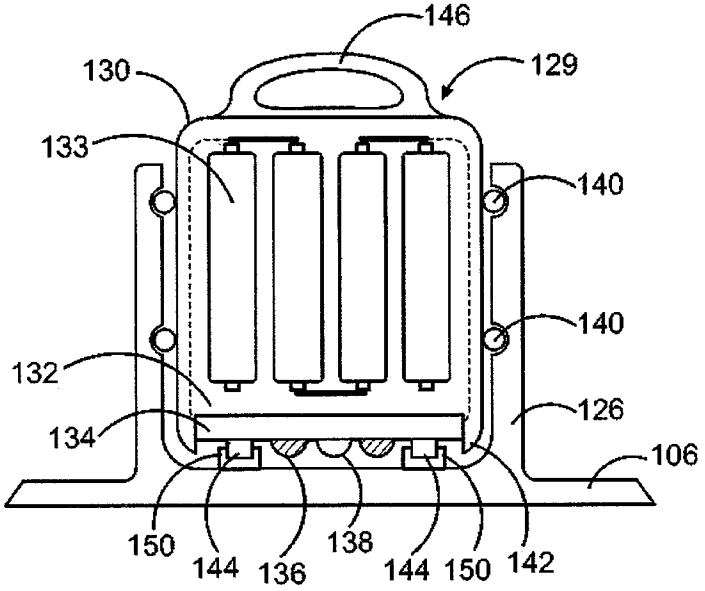
FIG. 3 is a section view of a battery compartment and a battery cartridge of the pool cleaner shown in FIG. 1.

Referring now to FIG. 3, a battery compartment 126 housing a removable battery cartridge 129 may be mounted on the base 106 or integrally formed with the base 106. The battery compartment 126 may be open at one end and closed at its opposite end. The battery cartridge 129 may include a battery housing 130. For purposes of illustration, but without limitation, the battery housing 130 may by cylindrical in shape and include a cavity 132 to house a plurality of AA batteries 133 or alternatively, rechargeable batteries. The battery housing 130 may be sealed by an end cap 134 that may be threadedly connected to internal threads formed proximate at the open end of the battery housing 130. Other modes of securing the end cap 134, such as screws or tabs, may also be employed. Externally located contacts on the end cap 134, such as a ring contact 136 and a button contact 138, may be electrically connected to the batteries 133.

The battery compartment 126 may be a separate unit mounted on the housing 102 or may be integrally formed with the base 106 of the housing 102. The battery compartment 126 is sized and configured to receive the battery cartridge 129 in a waterproof compartment. One or more 0-ring seals 140 provide a seal between the battery compartment 126 and the battery cartridge 129. The distal end of the battery housing 130 may include an inwardly tapered region 142 to aid with the insertion of the battery cartridge 129 into the battery compartment 126. Alignment tabs 144 may be included on the end cap 134. The tabs 144 may be received in alignment slots 150 in the battery compartment 126 to ensure that the battery cartridge 129 properly engages electrical contacts to complete the electrical circuit with the motor 120. A handle 146 on the battery housing 130 may be provided for convenient insertion or removal of the battery cartridge 129 from the battery compartment 126.

Referring again to FIG. 1, a coupling 145 may be pivotally attached to a bracket 147 which is connected to the base 106 of the housing 102. The coupling 145 may be of a configuration known in the art, for example, a swivel fork configuration and the like. The coupling 145 may include a connecting shaft 149 projecting therefrom. The shaft 149 may be received in a distal end of a hollow telescoping pole adapted for guiding the pool vacuum cleaner 100 over the surface of the pool. Fastener means known in the art, such as a snap clip and the like, may be provided to releasably join the telescoping pole to the coupling 145.

Figure 4:
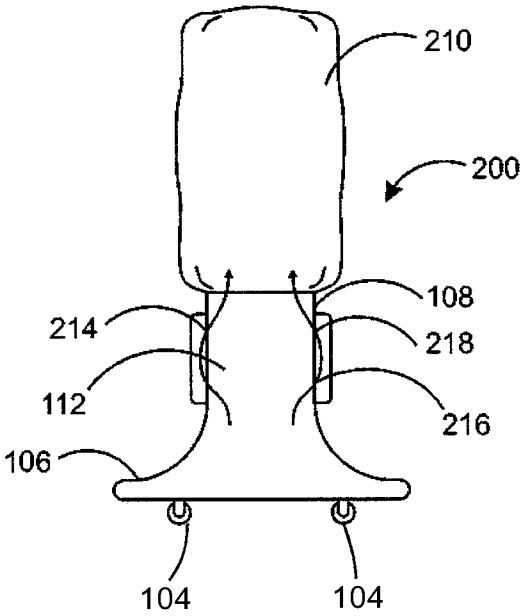
FIG. 4 is a side view of a second embodiment of an electrically powered pool cleaner.

Referring now to FIG. 4, an alternate embodiment of an electrically powered pool vacuum cleaner, is generally identified by the reference numeral 200. As indicated by the use of common reference numerals, the cleaner 200 is similar to the pool vacuum cleaner 100 with the exception that the cleaner 200 may include a hard cover 210 mounted on the housing 102 over the mesh filter bag. The top of the cover 210 may be perforated, permitting water to flow through the cover 210 back into the pool. The cover 210 may enhance the maneuverability of the cleaner 200 into tighter spaces and positioned in different orientations without the mesh filter bag flopping and draping over the housing 102 of the cleaner 200.

The cleaner 200 may further include a rotatable sleeve 214 mounted on the exterior of the housing 102. The sleeve 214 includes internal blades that upon rotation of the sleeve 214 draws fluid through a plurality of inlet ports 216 and discharges fluid through a plurality of outlet ports 218 in the conduit 108 at an accelerated velocity into the axial passageway 112, which in turn accelerates fluid flow through the passageway 112. Water and debris from below the pool cleaner 200 may thus be drawn upwardly through the passageway 112 and into the filter bag where the debris is trapped in the filter bag and the filtered water passes through the mesh bag and hard cover 210 back into the pool.

Figure 5:
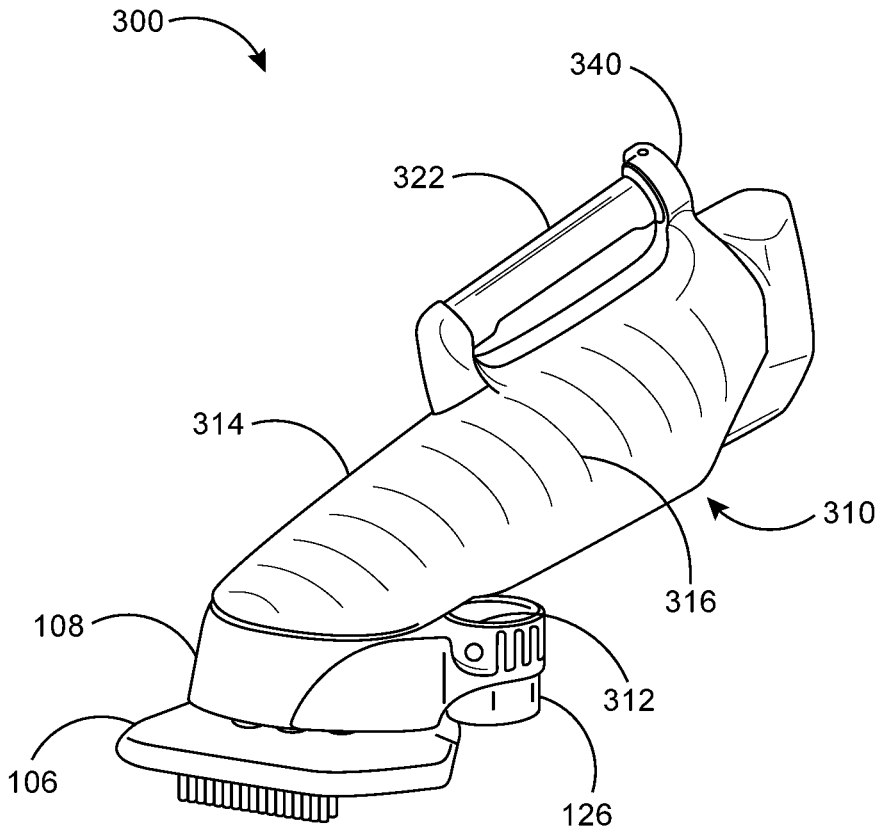
FIG. 5 is a perspective view of a third embodiment of an electrically powered pool cleaner.
Figure 6:
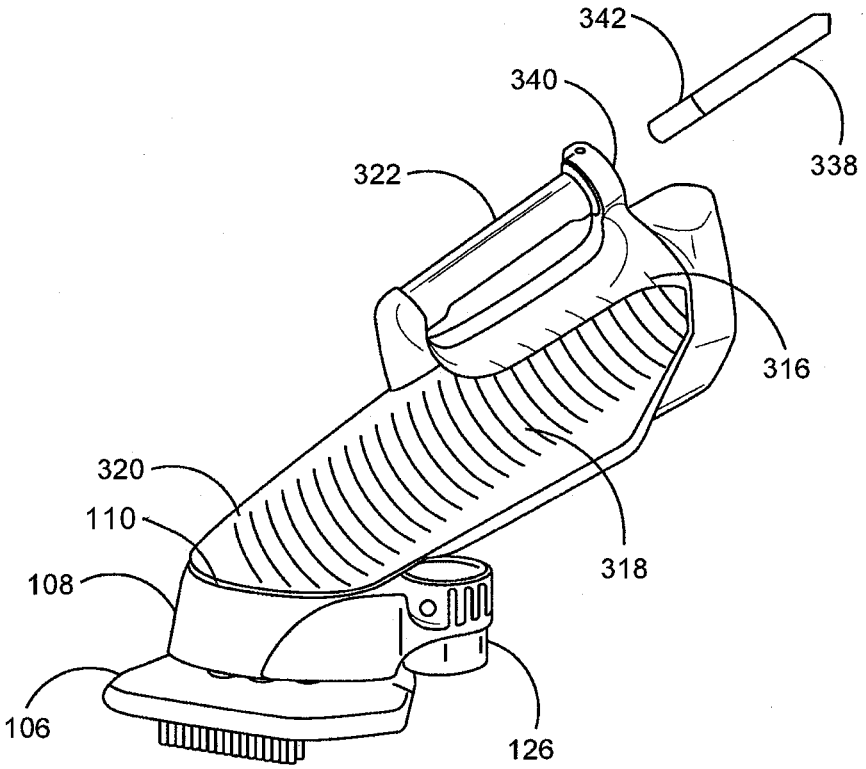
FIG. 6 is a partially broken away perspective view of the electrically powered pool cleaner shown in FIG. 5 depicting a rigid cover enclosing a filter bag.

Referring now to FIGS. 5 and 6, a third embodiment of an electrically powered pool vacuum cleaner is generally identified by the reference numeral 300. As indicated by the use of common reference numerals, the pool vacuum cleaner 300 is similar to the pool vacuum cleaner 100 with the exception that the pool vacuum cleaner 300 may include a handheld vacuum mode of operation.

The pool vacuum cleaner 300 may include a rigid filter cover 310 removably connected to the conduit 108. The filter cover 310 may be fabricated of plastic or other rigid material suitable for a swimming pool environment. The filter cover 310 may include a rim 312 circumscribing an open lower end thereof. The rim 312 may be configured for mating engagement with the lip 110 at the upper end of the conduit 108. The filter cover 310 may snap on to the lip 110 of the conduit 108 or removably connect therewith in any other manner known in the art.

The filter cover 310 may, for example but not by way of limitation, include an elongated hollow cylindrical body 314 extending generally upward at an angle from the conduit 108. The body 314 may include a plurality of openings 316, such as slits or other geometrical shapes, along the length thereof to permit water to flow through the filter cover 310. An internal flap 320 may be provided to prevent backflow of water and debris.

The filter cover 310 may enclose a filter bag 318 connected to the lip 110 of the conduit 108 or any other known methods for separating water from debris, such as rigid filter elements and the like. The filter bag 318 may extend out of the distal end of the filter cover 310. Alternatively, the distal end of the filter cover 310 may be closed by an end wall. The end wall may include a plurality of openings for water to flow through.

A handle 322 may be fixedly secured to or integrally formed with the filter cover 310. The handle 322 enables use of the pool vacuum cleaner 300 in a handheld mode. A typical pool vacuum cleaner with a filter bag attached is difficult to use on surfaces close to the top of a pool, such as but without limitation, stairs, seating benches and the like. As the filter bag generally needs to float above the pool vacuum cleaner, on higher surfaces the filter bag is out of the water and collapsed to the side of a pool vacuum cleaner and no longer capable of receiving debris. In the handheld mode of operation of the pool vacuum cleaner 300, the filter cover 310 may extend above the water surface while maintaining the filter bag 318 in an uncollapsed condition to continue receiving water therethrough and trapping any debris pulled by the water into the filter bag 318.

The pool vacuum cleaner 300 may also be used to vacuum the bottom of a pool by connecting it to a standard pool pole 338. The handle 322 may include a cavity 340 having internal threads and the like for coupling with a threaded end 342 of the pool pole 338. It is understood however that the pool pole 338 may be connected to the handle 322 by other means known in the art. The pool vacuum cleaner 300 may thus function as a combined pool cleaner that may be used to vacuum the bottom of a pool and also as a handheld pool cleaner by disconnecting the pool pole 338 from the handle 322 so that it may be picked up to vacuum the pool stairs or other surface close to the water line.

Figure 7:
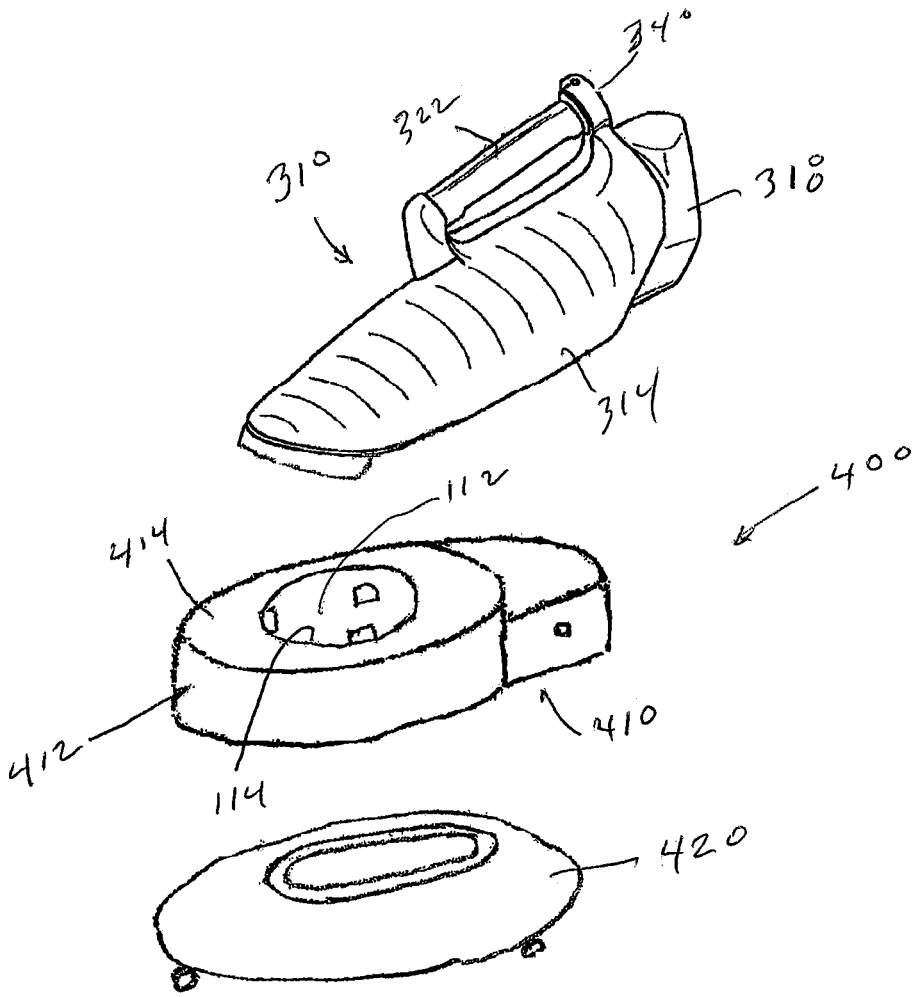
FIG. 7 is an exploded perspective view of a fourth embodiment of an electrically powered pool cleaner illustrating a power module and pool cleaner attachments that may be removably secured to the power module.
Figure 8:
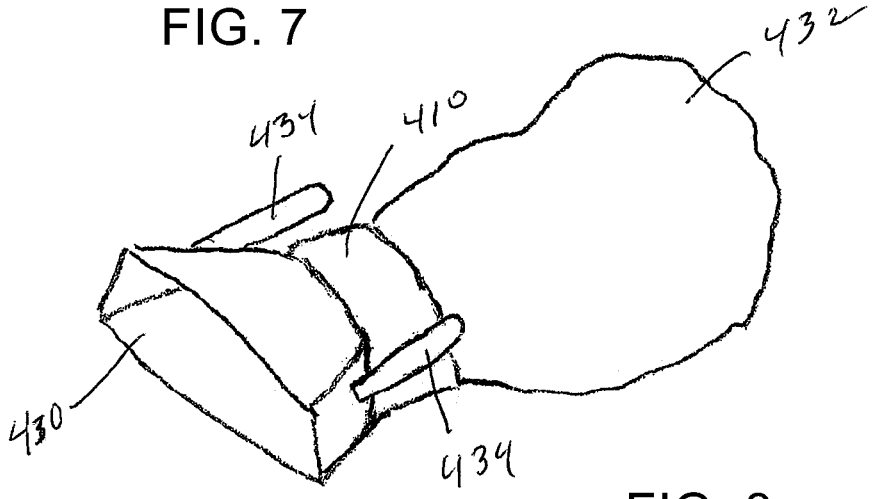
FIG. 8 is a perspective view of a surface skimmer and mesh bag removably secured to the power module shown in FIG. 7.

Referring now to FIGS. 7 and 8, a fourth embodiment of an electrically powered pool vacuum cleaner is generally identified by the reference numeral 400. As indicated by the use of common reference numerals, the pool vacuum cleaner 400 is similar to the pool vacuum cleaners 100 and 300 described above.

The pool vacuum cleaner 400 may include a power module 410 which may include a housing 412 defining, for example but without limitation, a generally cylindrical body 414 having an axial passageway 112 extending therethrough. The impeller or sleeve 114, described in greater detail hereinabove, may be rotatably supported within the axial passageway 112. The axial passageway 112 may be open at both ends defining a bottom inlet opening and a top outlet opening. A battery compartment and motor operatively connected to rotate the sleeve 114 may be enclosed in the housing 412.

The pool vacuum cleaner 400 may be configured to operate in at least three basic modes. In a first mode of operation, a base 420 may be attached to the bottom of the body 414 of the power module 410 and a mesh filter bag may be attached to the top of the body 414. The base 420 may be snapped on or twisted to interlock with tabs on the bottom of the power module body 414 or in any other manner known in the art. The base 420 is shown as a flared disk-shaped ring, however, it is understood that the base 420 may be rectangular, triangular, oval or any other shape having an opening extending therethrough.

In a second mode of operation, a rigid filter cover 310 may be removably connected to the top of the body 414 of the power module 410. A filter bag 318 may be enclosed within the filter cover 310.

In a third mode of operation, a surface skimmer 430 may be attached to the inlet end of the power module 410 and a filter bag 432 may be attached to the outlet end of the power module 410. The surface skimmer 430 may include floats 434 attached to the sides thereof to aid in maintaining the power module floating near the water surface so that debris on the surface of the water is pulled through the skimmer 430 and discharged into the filter bag 432. In this mode of operation, the power module 410 is oriented on it side providing a straight through flow path drawing water and surface debris through the skimmer 430, the passageway extending through the power module 410 and into the filter bag 432, where the debris may be retained and the filtered water discharged back into the pool.

The pool vacuum cleaner 400 provides a versatile pool cleaner to perform different pool cleaning functions. The power module 410 may be configured with different attachments to perform specific pool cleaning functions thereby eliminating the use of multiple separate pool cleaners.

While preferred embodiments of the invention have been shown and described, other and further embodiments of the invention may be devised without departing from the basic scope thereof, and the scope thereof is determined by the claims which follow.

The invention claimed is:

1. An electrically power pool cleaner, comprising:
a) a housing;
b) a sleeve rotatably supported in said housing, said sleeve including a plurality of blades projecting inward toward an unobstructed central portion of said housing;
c) a motor operatively connected to said sleeve; and
d) a power supply operatively connected to said motor.

2. The pool cleaner of claim 1 wherein said sleeve is rotatably supported in said housing by a plurality of rollers disposed between said sleeve said housing.

3. The pool cleaner of claim 1 wherein said power supply includes a battery compartment housing a removable battery cartridge.

4. The pool cleaner of claim 1 including a ring gear fixedly secured to said sleeve, said ring gear operatively engaged by a pinion gear driven by said motor.

5. The pool cleaner of claim 1 including a mesh filter bag removably secured to an outlet end of said housing, and further including a base removably secured to an inlet end of said housing.

6. The pool cleaner of claim 5 including a rigid cover secured to said outlet end of said housing over said mesh filter bag.

7. The pool cleaner of claim 1 including a rigid filter cover removably secured to said housing, said filter cover including a plurality of openings and a handle for handheld operation of the pool cleaner.

8. The pool cleaner of claim 7 wherein said handle includes a cavity adapted for coupling with an end of a pool pole.

9. The pool cleaner of claim 7 including a filter bag enclosed by said rigid filter cover.

10. An electrically power pool cleaner, comprising:
a) a power module, said power module including an inlet end and an outlet end;
b) a sleeve rotatably supported in said power module, said sleeve including a plurality of blades projecting inward toward an unobstructed central portion of said power module;
c) a motor operatively connected to said sleeve; and
d) a power supply operatively connected to said motor.

11. The pool cleaner of claim 10 including a filter bag removably connected to said outlet end of said power module, and further including a base removably secured to said inlet end of said power module.

12. The pool cleaner of claim 11 including a rigid cover secured to said outlet end of said power module over said filter bag.

13. The pool cleaner of claim 10 including a rigid filter cover removably secured to said power module, said filter cover including a plurality of openings and a handle for handheld operation of the pool cleaner.

14. The pool cleaner of claim 10 including a filter bag removably connected to said outlet end of said power module, and further including a surface skimmer removably secured to said inlet end of said power module.

* * * * *